United States Patent [19]

Nielsen

[11] Patent Number: 4,491,286

[45] Date of Patent: Jan. 1, 1985

[54] TUBE FOR YARN BOBBINS

[76] Inventor: Hans B. Nielsen, Bühlstrasse, CH-8125 Zollikerberg, Switzerland

[21] Appl. No.: 486,042

[22] Filed: Apr. 18, 1983

[30] Foreign Application Priority Data

Apr. 21, 1982 [GB] United Kingdom ..... 8211540

[51] Int. Cl.[3] ..... B65H 75/20

[52] U.S. Cl. ..... 242/118.11; 68/198

[58] Field of Search ..... 242/118, 118.1, 118.11, 242/118.2, 129, 130.1; 68/189, 198, 199

[56] References Cited

U.S. PATENT DOCUMENTS

| | | | |
|---|---|---|---|
| 493,845 | 3/1893 | Scott | 242/118.2 |
| 2,936,964 | 5/1960 | Tigges | 242/118.1 |
| 4,180,219 | 12/1979 | Becker et al. | 242/118.1 |
| 4,379,529 | 4/1983 | Nielsen | 242/118.11 |

*Primary Examiner*—Leonard D. Christian

*Attorney, Agent, or Firm*—Cushman, Darby & Cushman

[57] ABSTRACT

A tube of plastic for yarn bobbins of the conical type which has one or more V-shaped slits substantially along generatrices of the cone surface and extending at least over the major part of the tube length, the pointed end of the slit being in the broad end of the tube and the open end of the slit being in the narrow end of the tube.

5 Claims, 7 Drawing Figures

TUBE FOR YARN BOBBINS

The present invention relates to a tube of plastic for yarn bobbins of the conical type.

Tubes for yarn bobbins are meant to retain the yarn reeled on the tube while it is being subjected to a liquid treatment, in particular a dyeing with subsequent drying, in an apparatus in which several tubes are placed end to end on perforated distributor pipes and in which the treatment liquid is pumped in or out through the yarn.

Tubes of the conical type which have a perforated frusto-conical surface on which the yarn is reeled may be of the type which is placed end to end on the distributor pipes with intermediate discs between every two tubes or they may be of the type which is placed directly end to end on the distributor pipes without intermediate discs so that the narrow end of one conical tube fits into the broad end of the following tube. These latter have the advantage that the tubes with the yarn reeled thereon can then be compressed so that the space in the dyeing apparatus can be better exploited which in turn results in a lower comsumption of water and chemicals so that economy as well as a lower amount of waste liquid is obtained.

However, the conical tubes designed to be compressed when they are placed on the distributor pipes also have a substantial drawback compared to the tubes which cannot be compressed on account of the intermediate discs, viz. the drawback that during the compression of the tubes the yarn frictions against the surface of the tube seeing that it is pressed towards a constantly increasing diameter whereby it may be damaged. Moreover, hereby non-homogeneous yarn density may be created and resulting uneven colourations. This is due to the fact that the yarn is always reeled on the tube with a certain tension of thread so that the tube is loaded with a normal pressure depending on the thread tension, and when the yarn is pressed in the direction of a larger diameter this normal pressure increases during the compression resulting in increasing frictional force.

The drawback is avoided by the tube according to the invention which is of the conical type the narrow end of which fits into the broad end and which has a perforated cone surface to carry the yarn. The inventive feature of the tube is the fact that substantially along one or more generatrices of the cone surface there is a V-shaped slit extending at least over the major part of the length of the tube and the pointed end of which is in the broad end of the tube and the open end of which is in the narrow end of the tube.

As explained in detail in the following it is hereby obtained that the conicity of the tube increases concurrently with the compression so that the normal pressure between yarn and tube during the entire compression is very small and the frictional force therefore also very small. Hereby the tubes with the yarn reeled on them can be compressed without the yarn suffering damage and in such a way that homogeneous density of the yarn is obtained.

In principle the V-shaped slit may also extend along a line which forms an acute angle with the generatrices of the cone surface and functions in the same way, and the slit may extend through the whole length of the tube although it is preferred that a limited part of the broad end of the tube is unbroken. If the tube has more than one slit it is obvious that only one of these can extend through the entire length of the tube.

According to the invention the yarn carrying cone surface of the tube is suitably constituted by outward projecting ribs which extend along generatrices of the cone surface and the V-shaped slit or each of the V-shaped slits is situated between two such ribs and is formed in a portion of the tube material which lies under the yarn carrying surface formed by the outer surface of the ribs. Hereby is prevented that the slit can wedge the inner yarn layer tight when it is squeezed together during the compression.

An embodiment in which the yarn carrying cone surface is constituted by ribs is advantageous because the yarn slides more easily on such ribs during the compression, but it has the drawback that a denser compression of the inner yarn layers over the ribs is obtained than over the spaces between the ribs. Therefore, the tube may also advantageously be so designed that it is the perforated conical wall which constitutes the yarn carrying surface and that the V-shaped slit(s) is (are) located at any desired places in the conical wall. In order to avoid that during compression the yarn is caught by the edges of the perforations in such a tube the edges of the perforations which face the narrow end of the cone are suitably rounded or bevelled.

In order to secure exact closing of the slit tube the faces of the slit or slits are suitably profiled near the open end of the slits. The two faces may e.g. have a V-shaped cross section or be elaborated as groove and tongue or be respectively a convex and a concave surface.

The invention is further illustrated in the drawing where

FIGS. 1 and 2 are views which show longitudinal sections of one-half of a tube according to the invention in two different situations, FIG. 3 is a sectional view taken along the line 3—3 in FIG. 1, FIG. 4 is a sectional view taken along the line 4—4 in FIG. 1, FIGS. 5, 6, and 7 are simplified diagrammes illustrating the principle of the effect of the slit tube according to the invention.

As shown in FIGS. 1–4 the tube according to the invention comprises an end ring 1 in the broad end and an end ring 2 in the narrow end and between these one or more stiffening rings 2. Between the rings 1, 2, and 3 extends a conical wall 4 which has perforations 5 and projecting ribs 6 the outer faces 7 of which constitute the surfaces which are to carry the reeled yarn. The end ring 1 in the broad end of the tube is unbroken but the other end ring 2 and the intermediate rings 3 and the wall 4 are broken by a V-shaped slit 8 which extends along a generatrix of the conical wall and extends from the closed end of the V in a point 9 near the end ring 1 to the open end of the V in the end ring 2. In FIG. 1 the tube is shown as manufactured with the slit 8 open, and in FIG. 2 the tube is shown as it is when the slit 8 is squeezed together by reeled yarn, and here the slit is marked by the line 10. The slit 8 forms only a very small angle, e.g. of the order of 5° so that the stress to which the tube is subjected when the slit is broadened or squeezed together is very low and can easily be absorbed by the resilience of the plastic material which is generally used for tubes for yarn bobbins. In the outermost end of the slit the faces 11, 12 of the slit are profiled as shown in FIG. 3 so that they provide guides when the slit is squeezed together. The inside of the end ring 1 in the broad end of the tube is shown as a smooth surface 13 which is not provided with grooves to accomodate the ribs 6 in the narrow end of the tube so that it is unnecessary to rotate one tube when it is put down on another tube when the tubes are stacked on a distributor pipe in a yarn dyeing apparatus. But grooves inside the broad end ring 1 to accomodate the ribs 6 in the narrow end of the tube may be suitable to avoid that yarn gets jammed between the tubes seeing that it is the broad end ring 1 that pushes the yarn in front of itself when the tubes are compressed, but in that event the grooves are best designed with a greater width than the width of the ribs 6 so that the ribs are more easily caught by the grooves.

The conicity of the tube depends on its dimensions, i.e. both its length and its wall thickness. Since the narrow end of the cone shall fit into the broad end of the cone a large thickness of material in the end ring 1 will result in a high conicity, but if the thickness of material is small, as e.g. for a disposable tube, the conicity may be very low. The conicity may in some cases go to the limit, i.e. cylinder form, in the sense that the tube is only conical when the V-shaped slit or slits are squeezed together.

In practice the tubes are made so that the outermost portion of the narrow end which is to fit into the broad end of the tube is cylindrical. Thus, a cone surface is present only between the points 14 and 15 in FIGS. 1 and 2.

FIG. 6 shows the tube in the condition in which it is on the reeling machine. Here the tube is held by flanges in the two end rings with the slit open so that the diameter of the narrow end is c, the diameter at the most narrow location where yarn is reeled is b, and the diameter at the broadest location where yarn is reeled is a.

Figure 1:
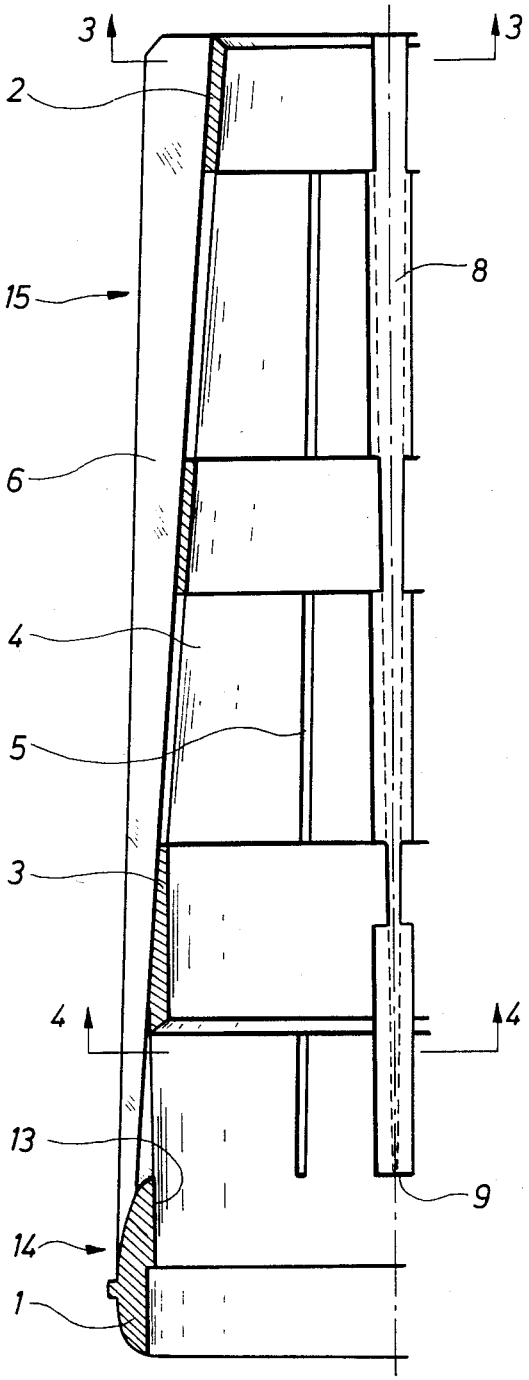
Figure 2:
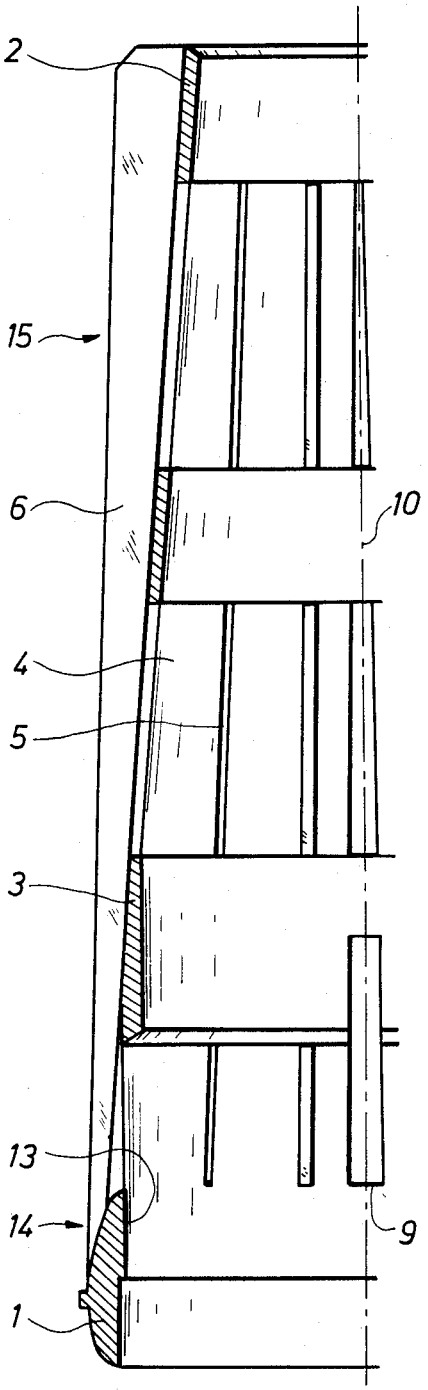
Figure 3:
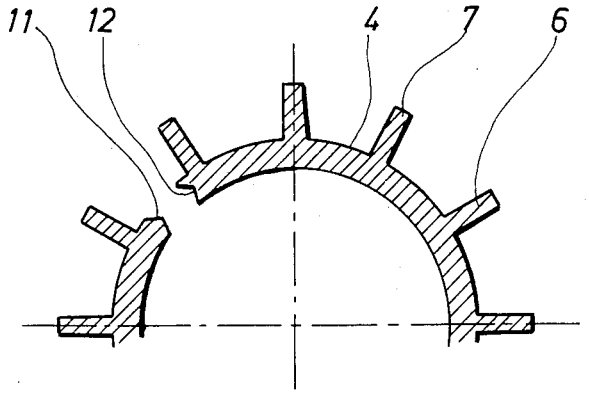
Figure 4:
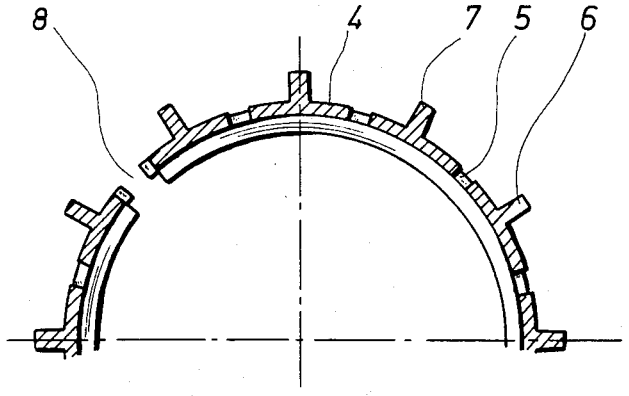
Figure 5:
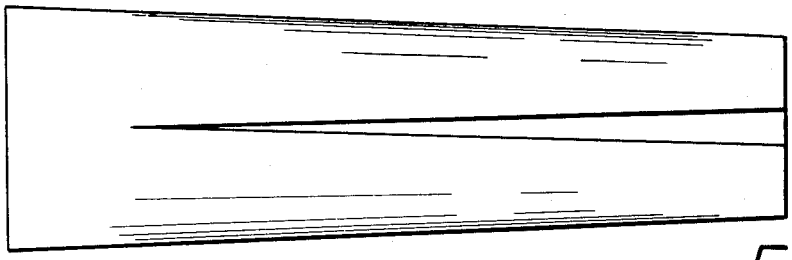
FIG. 5 shows a simplified illustration of a tube according to the invention.
Figure 6:
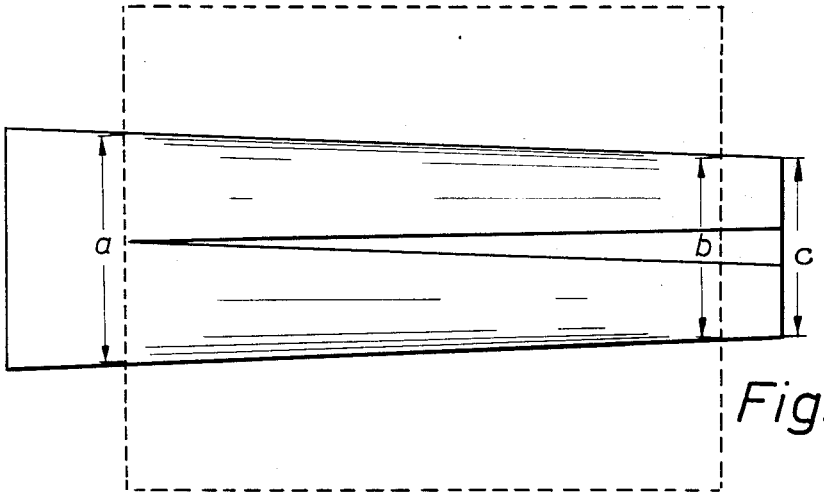
Figure 7:
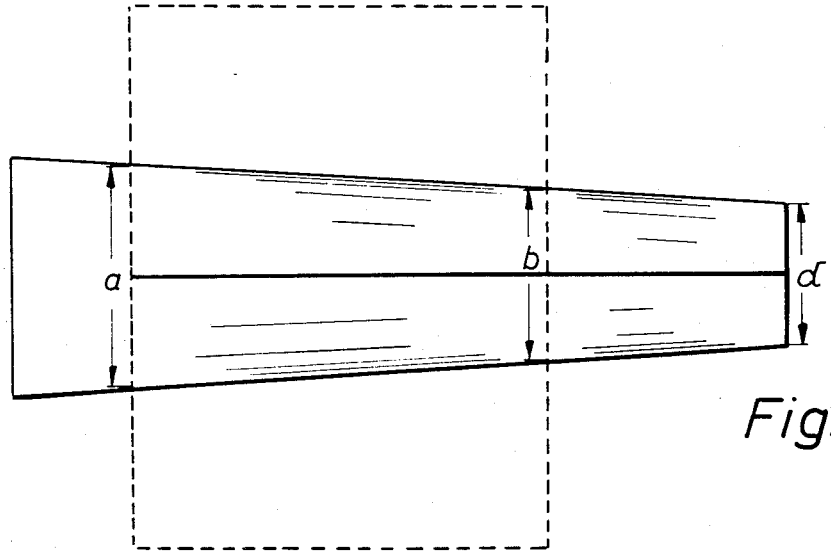

FIG. 7 shows the tube after the yarn has been compressed in the longitudinal direction of the tube, and the tube is thereby pressed together in the radial direction so that the slit is closed. The diameter of the tube in the narrow end is now d which is smaller than c, and thereby the conicity of the tube has increased seeing that the diameter of the tube at the broadest location where yarn is reeled is still a. The tube diameter b is now at a point which is farther from the narrow end than was the case in FIG. 6 so that during the compression it has not been necessary to force the yarn up onto a larger diameter.

I claim:

1. A tube of plastic for yarn bobbins of the conical type the narrow end of which fits into the broad end and which has a perforated cone surface to carry the yarn during liquid treatment, characterized in having, substantially along one or more generatrices of the cone surface, at least one V-shaped slit extending at least over the major part of the length of the tube, said slit having a pointed end located in the broad end of the tube and having an open end located in the narrow end of the tube.

2. A tube as claimed in claim 1, characterized in that the yarn carrying cone surface is constituted by outward projecting ribs which extend along generatrices of the cone surface and the V-shaped slit is situated between two such ribs and is formed in a portion of the tube material which lies under the yarn carrying surface formed by the outer surfaces of the ribs.

3. A tube as claimed in claim 1, characterized in that the perforated conical wall constitutes the yarn carrying surface and that the V-shaped slit located at any desired place in the conical wall.

4. A tube as claimed in claim 1, characterized in that the faces of the slit are profiled near the open end of the slits.

5. A plastic tube for retaining yarn wound thereon while being subjected to a liquid treatment in an apparatus in which a plurality of tubes are placed end-to-end on a perforated distributor pipe and in which treatment liquid is pumped through the wound yarn, said tube having a narrow end and a broad end and a conically-shaped yarn-carrying surface extending between said ends, said narrow end having an outside diameter less than the inside diameter of said broad end whereby said narrow end can fit into the broad end of an adjacent end of a tube of the same construction so that compression of the wound yarn and of the tube can be effected, said tube having a V-shaped slit extending longitudinally along a major part of the length of said tube, said slit having a pointed end spaced from the broad end of said tube and a wide end open through the narrow end of said tube, said slit permitting radial compression of that longitudinal portion of said tube between the pointed end of the slit and the narrow end of the tube upon compression of yarn wound on said tube so that the conicity of said tube increases concurrently with compression.

* * * * *